US011674469B1

(12) United States Patent
Dudar

(10) Patent No.: US 11,674,469 B1
(45) Date of Patent: Jun. 13, 2023

(54) SYSTEMS AND METHODS FOR EVAPORATIVE EMISSIONS SYSTEMS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/809,401

(22) Filed: Jun. 28, 2022

(51) Int. Cl.
*F02D 41/22* (2006.01)
*F02D 41/00* (2006.01)
*F02M 25/08* (2006.01)

(52) U.S. Cl.
CPC ..... *F02D 41/222* (2013.01); *F02D 41/0037* (2013.01); *F02D 41/0045* (2013.01); *F02M 25/0836* (2013.01); *F02D 2041/223* (2013.01); *F02D 2041/228* (2013.01)

(58) Field of Classification Search
CPC ..... F02D 41/0037; F02D 41/0045; F02D 41/222; F02D 2041/223; F02D 2041/228; F02M 25/0836
See application file for complete search history.

(56) References Cited

U.S. PATENT DOCUMENTS 8,447,495 B2 5/2013 Pearce et al.
9,217,397 B2 12/2015 Peters et al.
9,284,924 B2 * 3/2016 Dudar ..... F02M 25/089
9,523,317 B1 12/2016 Li
9,709,007 B2 * 7/2017 Dudar ..... F02D 41/144
9,751,396 B2 9/2017 Dudar
10,054,070 B2 8/2018 Dudar et al.
10,100,770 B2 10/2018 Dudar
10,233,857 B2 3/2019 Dudar
10,385,795 B2 8/2019 Dudar et al.
10,451,010 B2 10/2019 Dudar
10,760,532 B1 9/2020 Dudar
11,148,930 B2 10/2021 Dudar
2015/0085894 A1 3/2015 Yang et al.
2016/0215734 A1 7/2016 Dudar
2020/0102203 A1 4/2020 Dudar
2020/0370516 A1 11/2020 Dudar

FOREIGN PATENT DOCUMENTS

KR 20020051776 A 6/2002

OTHER PUBLICATIONS

Dudar, A., "Methods and Systems for Determining Integrity of Fuel Tank Pressure Transducer," U.S. Appl. No. 17/454,951, filed Nov. 15, 2021, 53 pages.
Dudar, A., "Method and System for Diagnosing Fuel Tank Pressure Sensor," U.S. Appl. No. 17/653,698, filed Mar. 7, 2022, 34 pages.

* cited by examiner

*Primary Examiner* — Hung Q Nguyen
*Assistant Examiner* — Mark L. Greene
(74) *Attorney, Agent, or Firm* — Vincent Mastrogiacomo; McCoy Russell LLP

(57) ABSTRACT

Methods and systems are provided for a diagnostic of a pressure sensor. In one example, a method includes bypassing one or more vapor canisters and determining a condition of the pressure sensor based on feedback from a hydrocarbon sensor.

20 Claims, 5 Drawing Sheets

SYSTEMS AND METHODS FOR EVAPORATIVE EMISSIONS SYSTEMS

FIELD

The present description relates generally to diagnosing a pressure sensor of a fuel system.

BACKGROUND/SUMMARY

Vehicle fuel systems include evaporative emissions control systems designed to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emissions control system allows the vapors to be purged into the engine intake manifold for use as fuel.

As evaporative emissions standards increasingly become stricter, vehicle systems may be configured with a plurality of canisters in series. As the canisters in series become loaded with fuel vapor, the flow of fuel vapor or air through a loaded canister may become increasingly restricted. Accordingly, during a refueling event, the increased restriction to fuel vapor flow due to one or more saturated fuel vapor canisters may lead to premature shutoffs of a refueling dispenser that is adding fuel to a fuel tank. Canister degradation over time may also lead to fluid flow restriction, which may adversely impact refueling and/or canister purging operations. For example, for multi-canister evaporative emissions system configured in series there may be a number of potential locations where restrictions may develop over time, which may impede fluid flow for refueling and/or canister purging operations. For example, canister degradation that may lead to fluid flow restriction may include accumulation of dust or debris inside a canister, liquid fouling of activated carbon included in a canister, etc. Other potential locations for restrictions include evaporative emissions system valves which may become stuck at least partially closed over time.

Many systems include diagnostics configured to diagnose conditions of the canister, the evaporative emissions system, and/or a fuel tank. The diagnostics may utilize a fuel tank pressure sensor during the diagnostic routines. For example, the pressure sensor may be used to diagnose leaks in the fuel tank. As another example, the pressure sensor may be used to determine if a sensor in the evaporative emissions system is degraded or if a restriction is present. Thus, accurate operation of the pressure sensor is desired for reliable diagnostic feedback. However, methods for diagnosing a condition of the pressure sensor are limited and service centers often replace the pressure sensor in response to a diagnostic fault code, which increases service costs and waste.

In one example, the issues described above may be addressed by a method including flowing gases directly to a hydrocarbon sensor via a canister bypass and diagnosing a condition of a fuel tank pressure transducer (FTPT) based on a response of the hydrocarbon sensor. In this way, the hydrocarbon sensor output may be compared to a threshold value based on a positive pressure in the fuel tank. If the FTPT senses zero pressure and the hydrocarbon sensor senses a hydrocarbon value greater than the threshold value, the FTPT may be degraded.

As one example, evaporative emissions system may include a hydrocarbon sensor arranged between a downstream canister and atmosphere to determine if vapors are leaking to atmosphere. The methods included herein may utilize the hydrocarbon sensor to diagnose a condition of the FTPT. During an engine on event, after the canisters are purged, vapors may be bypassed around one or more canisters directly to the hydrocarbon sensor via a canister bypass. If the hydrocarbon sensor senses an amount of hydrocarbons greater than the threshold value, then pressure in the fuel tank may be equal to a positive value. If the FTPT outputs a zero pressure value when the hydrocarbon sensor senses the amount of hydrocarbons greater than the threshold value, then the FTPT may be degraded. By doing this, a condition of the FTPT may be determined without the inclusion of additional hardware, thereby decreasing manufacturing costs while improving diagnostic results.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
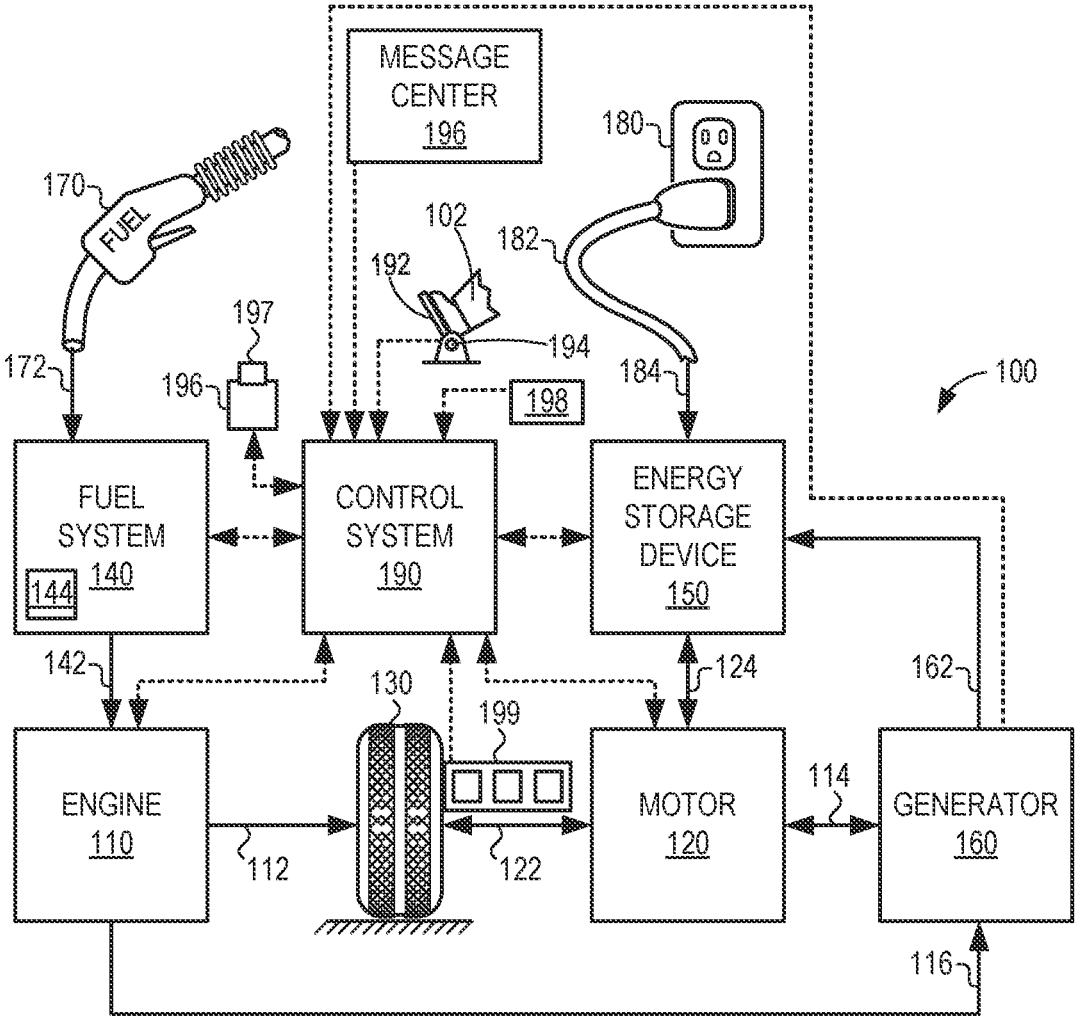
FIG. 1 schematically shows an example vehicle propulsion system.
Figure 2:
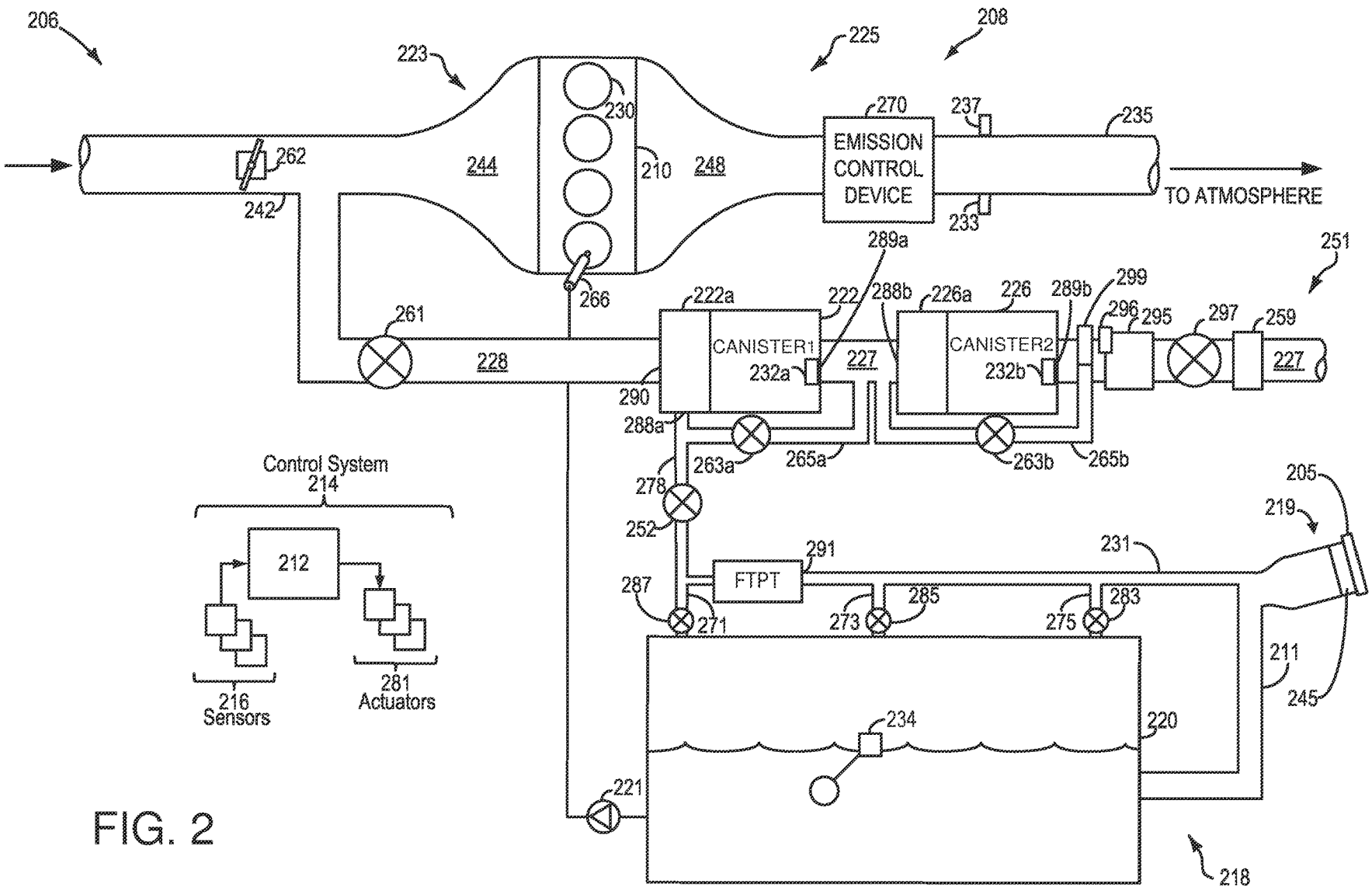
FIG. 2 schematically shows an example vehicle system with a fuel system and an evaporative emissions system.
Figure 4:
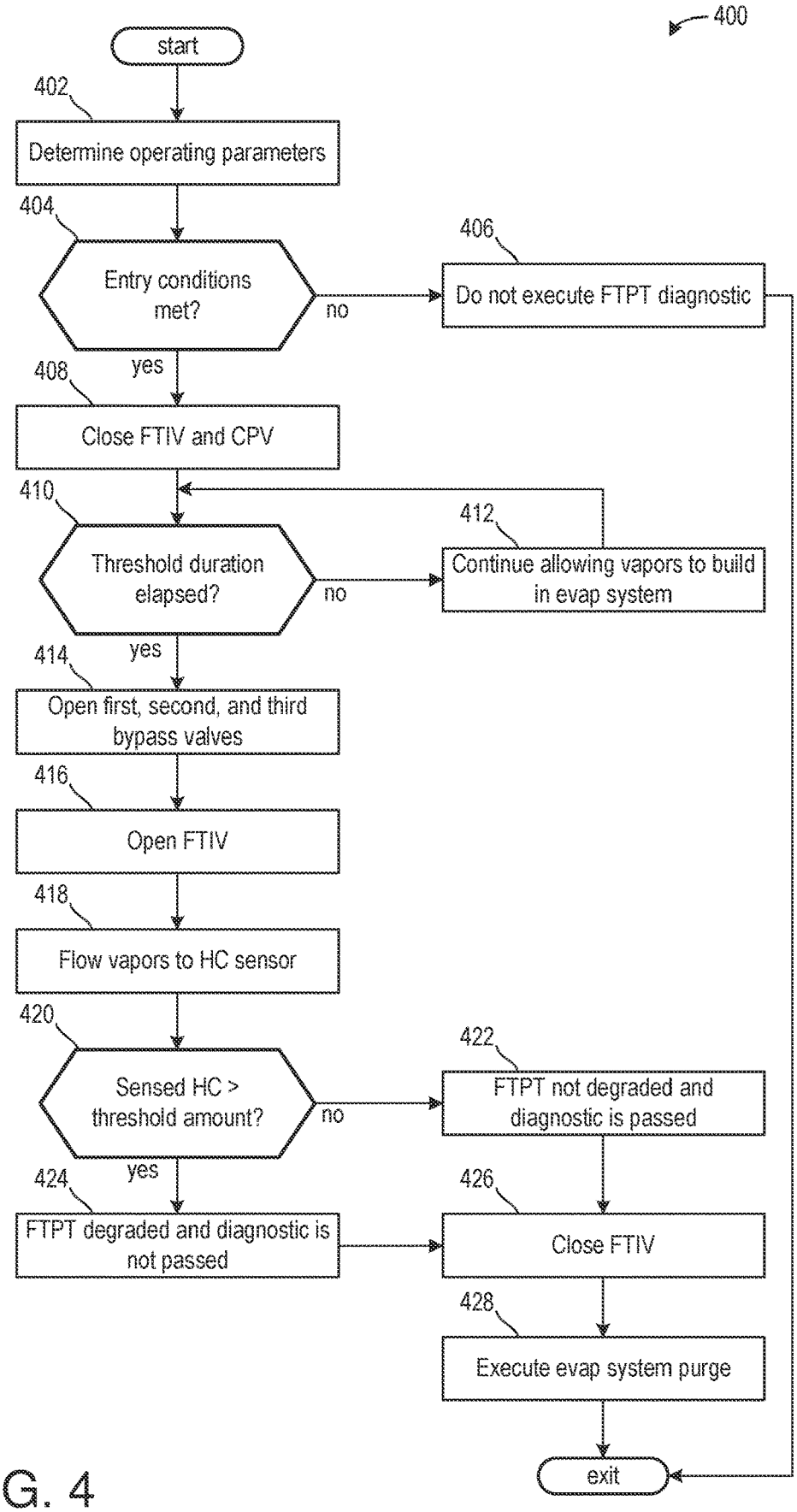
FIG. 4 illustrates a method for diagnosing a FTPT.
Figure 5:
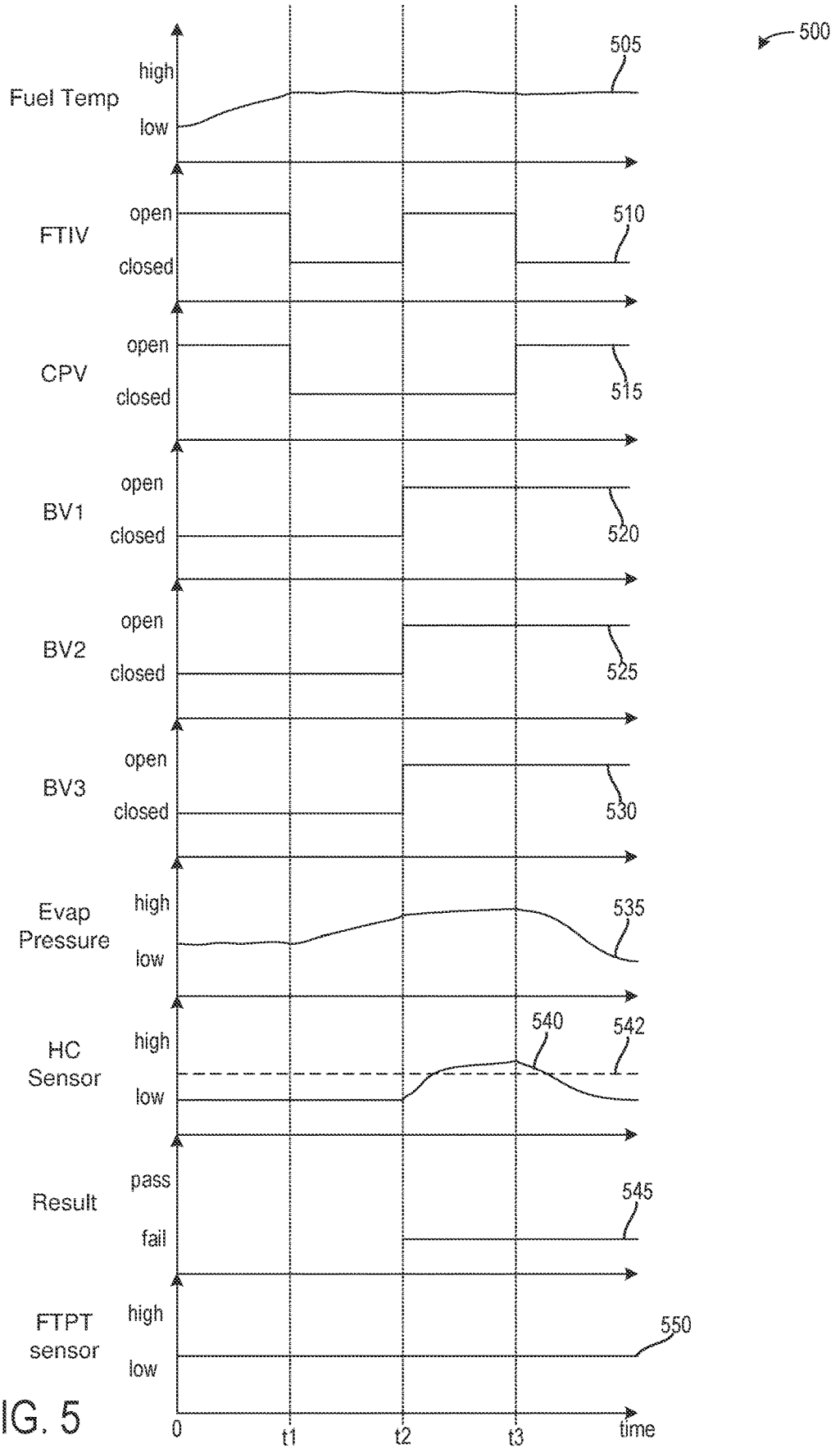
FIG. 5 illustrates a timeline of the method for diagnosing the FTPT.

The systems and methods discussed herein are applicable to hybrid electric vehicles, such as the vehicle propulsion system depicted at FIG. 1. However, the systems and methods discussed herein may apply to non-hybrid vehicles without departing from the scope of this disclosure. FIG. 2 depicts an evaporative emissions system with two fuel vapor storage canisters configured in series, however the systems and methods discussed herein may apply to evaporative emissions systems with more than two fuel vapor storage canisters, such as the evaporative emissions systems depicted in FIG. 3. A method for diagnosing a FTPT in response to the leak diagnostic being passed is shown in FIG. 4. A timeline of the FTPT diagnostic is shown in FIG. 5.

Figure 3:
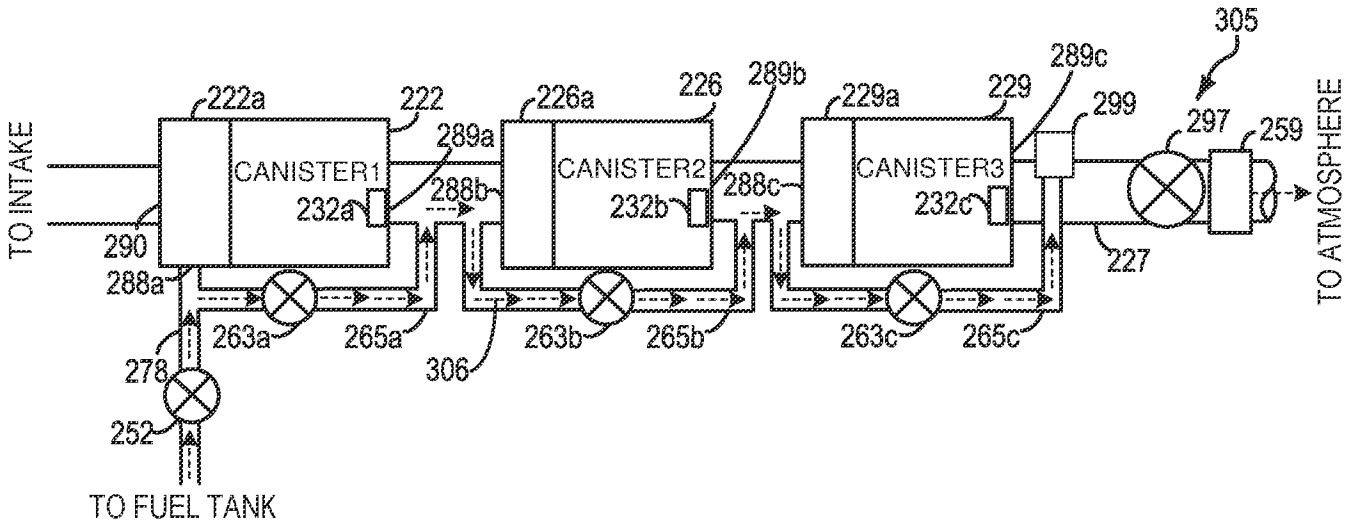
FIG. 3 an example embodiment of a multi-canister evaporative emissions system with three canisters and three bypass valves.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

In some examples, vehicle propulsion system 100 may include an onboard navigation system 195 (for example a Global Positioning System) that an operator of the vehicle may interact with. The navigation system 195 may include one or more location sensors for assisting in estimating vehicle speed, vehicle altitude, vehicle position/location, etc. This information may be used to infer engine operating parameters, such as local barometric pressure, an engine idle event, etc. Control system 190 may in some examples further be configured to receive information via the internet or other communication networks. Information received from the GPS may be cross-referenced to information available via the internet to determine local weather conditions, local vehicle regulations, traffic information, etc.

Control system 190 may in some examples be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, vehicle control system 190 may be communicatively coupled to other vehicles or infrastructures via a wireless network 131 and the internet (e.g. cloud), as is commonly known in the art.

FIG. 2 shows a schematic depiction of a vehicle system 206. The vehicle system 206 includes an engine system 208 coupled to an emissions control system 251 and a fuel system 218. It may be understood that vehicle system 206 may be included in vehicle propulsion system 100. Emission control system 251 includes a plurality of fuel vapor containers or canisters (e.g., first fuel vapor canister 222 and second fuel vapor canister 226) which may be used to capture and store fuel vapors. In some examples, vehicle system 206 may be a hybrid electric vehicle system.

The engine system 208 may include engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more exhaust catalyst(s) 270, also referred to herein as emission control devices, which may be mounted in a close-coupled position in the exhaust. The one or more emission control devices may include a three-way catalyst, lean NOx trap, diesel particulate filter, oxidation catalyst, etc. It will be appreciated that other components may be included in the engine such as a variety of valves and sensors.

Fuel system 218 may include fuel tank 144 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 144 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251, which includes one or more serially arranged fuel vapor canisters (e.g., first fuel vapor canister 222 and second fuel vapor canister 226), via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be included in conduits 271, 273, or 275. Among other functions, the fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 144 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters (e.g., first fuel vapor canister 222; second fuel vapor canister 226), each filled with an appropriate adsorbent. A first fuel vapor canister (e.g., 222) may include a load port 288*a*, a vent port 289*a*, and a purge port 290. A second fuel vapor canister (e.g., 226) man include a load/purge port 288*b*, and a vent port 289*b*. The canisters may be configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the one or more canisters (e.g., first vapor canister 222; second fuel vapor canister 226) to the atmosphere when storing, or trapping, fuel vapors from fuel system 218.

In some examples, emissions control system 251 may include one or more bypass conduits for bypassing one or more canisters of the multi-canister system. Each bypass conduit may be arranged to bypass at least one canister. For example, a first bypass conduit 265*a*, with a first bypass valve 263*a* may be configured such that, when open, fuel tank vapors may be routed to the second fuel vapor canister 226 from fuel tank 220 while bypassing the first fuel vapor canister 222. In other words, the first bypass valve may be configured to couple and uncouple the routing of fuel tank vapors to the second fuel vapor canister. The first bypass conduit 265*a* may be coupled at one end to a fuel vapor conduit 278, and may couple at the other end to vent line 227 (e.g., first segment of vent line 227) at a junction between first fuel vapor canister 222 and the second fuel vapor canister 226. Bypass valve 263*a* may be controlled via commands from the controller 212. Discussed herein, bypass valve 263*a* (and other similar bypass valves in the case of more than two canisters) may comprise a bistable latchable valve, latchable in both a closed configuration and an open configuration. For example, a 100 ms pulse command sent to an actuator (not shown) of the bypass valve may result in the bypass valve opening, at which point it may be latched in the open position or configuration. In response to another 100 ms pulse, for example, the bypass valve may be commanded closed, at which point it may be latched in the closed position or configuration. By enabling the bypass valve to be latched in the open and closed position, electrical energy consumption for maintaining the bypass valve either open or closed may be lowered, and may enable the controller to go to sleep once the valve is energized to its desired state.

As fuel vapor is adsorbed by the adsorbent in the canister, heat is generated (in particular, heat of adsorption), and likewise, as fuel vapor is desorbed by the adsorbent in the canister, heat is consumed. Thus the adsorption and desorption of fuel vapor by the canister may be monitored and estimated based on temperature changes within the canister. Accordingly, depicted is a first canister temperature sensor 232*a* positioned in canister 222, and a second canister temperature sensor 232*b* positioned in canister 226. While one canister temperature sensor is depicted for each of canister 222 and canister 226, it may be understood that each canister may include a plurality of temperature sensors without departing from the scope of this disclosure.

While two fuel vapor canisters are depicted at FIG. 2 (first fuel vapor canister 222 and second fuel vapor canister 226), it may be appreciated that any number of fuel vapor canisters may be arranged in series, in similar fashion, as will be elaborated in greater detail with respect to FIG. 3. Furthermore, as depicted at FIG. 2, a first bypass conduit 265*a* is shown for bypassing the first canister 222 and a second bypass conduit 265*b* is shown for bypassing the second canister 226 and flowing vapors directly to a hydrocarbon sensor 299. Vapor flow through the second bypass conduit 265*b* may be controlled via a second valve 263*b*.

First fuel vapor canister 222 and second fuel vapor canister 226 may include a first buffer 222*a*, and a second buffer 226*a* (or buffer region), each of the canister and the buffer comprising the adsorbent. As shown, the volume of buffer (e.g., 222*a*, 226*a*) may be smaller than (e.g., a fraction of) the volume of the fuel vapor canister (e.g., 222, 226). The adsorbent in the buffer (e.g., 222*a*, 226*a*) may be same as, or different from, the adsorbent in the canister (e.g., both may include charcoal). The buffer(s) may be positioned within the one or more canisters such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Vent line 227 may also allow fresh air to be drawn into first fuel vapor canister 222 and second fuel vapor canister 226 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the one or more fuel vapor canister(s) for purging. In some examples, vent line 227 may include an air filter 259 disposed therein upstream of second fuel vapor canister 226.

In some examples, the flow of air and vapors between first fuel vapor canister 222, second fuel vapor canister 226, and the atmosphere may be regulated by a canister vent valve 297 coupled within vent line 227 (e.g., within a second segment of vent line 227). When included, the canister vent valve may be a normally open valve, so that a fuel tank isolation valve (FTIV) 252, when included, may control venting of fuel tank 220 with the atmosphere. FTIV 252, when included, may be positioned between the fuel tank and the fuel vapor canister within fuel vapor conduit 278. FTIV 252 may be a normally closed valve, that when opened, allows for the venting of fuel vapors from fuel tank 220 to first fuel vapor canister 222, or, as described further herein, routing of fuel vapors around first fuel vapor canister 222 to second fuel vapor canister 226. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open FTIV 252, when included, while closing canister purge valve (CPV) 261 to direct refueling vapors into the one or more fuel vapor canisters (e.g., first fuel vapor canister 222, second fuel vapor canister 226) while preventing fuel vapors from being directed into the intake manifold.

As another example, the fuel system may be operated in a refueling mode (e.g., when fuel tank refueling is requested by a vehicle operator), wherein the controller 212 may open FTIV 252, when included, while maintaining canister purge valve 261 closed, to depressurize the fuel tank before allowing enabling fuel to be added therein. As such, FTIV 252, when included, may be kept open during the refueling operation to allow refueling vapors to be stored in the one or more fuel vapor canisters (e.g., first fuel vapor canister 222, second fuel vapor canister 226). After refueling is completed, the FTIV 252, when included, may be closed.

As yet another example, the fuel system may be operated in a canister purging mode (e.g., after an emission control device light-off temperature has been attained and with the engine running), wherein the controller 212 may open canister purge valve 261 while closing isolation valve 252 (when included). Herein, the vacuum generated by the intake manifold of the operating engine may be used to draw fresh air through vent 227 and through first fuel vapor canister 222 and second fuel vapor canister 226 to purge the stored fuel vapors into intake manifold 244. In other words, air flow may be directed through the second fuel vapor canister and the first fuel vapor canister, out of the purge port of the first fuel vapor canister to the engine intake manifold to purge fuel vapors stored in the first fuel vapor canister and the second fuel vapor canister to the engine intake manifold. In this mode, the purged fuel vapors from the one or more fuel vapor canisters are combusted in the engine. The purging may be continued until the stored fuel vapor amount in the one or more fuel vapor canisters is below a threshold. As will be discussed in further detail below, under certain circumstances it may be desirable to bypass one or more canisters during purging operations.

Controller 212 may comprise a portion of a control system 214. It may be understood that control system 214 may comprise the same control system as control system 190 depicted at FIG. 1. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291 (fuel tank pressure transducer (FTPT) 291), first canister temperature sensor 232*a* and second canister temperature sensor 232*b*, and the hydrocarbon sensor 299. Other sensors such as pressure, temperature, air/fuel ratio, and composition sensors may be coupled to various locations in the vehicle system 206. As another example, the actuators may include throttle 262, FTIV 252, canister purge valve 261, and canister vent valve 297, first bypass valve 263*a*, second bypass valve 263*b*, etc. The controller 212 may receive input data from the various sensors, process the input data, and trigger the actuators in response to the processed input data based on instruction or code programmed therein corresponding to one or more routines.

In some examples, the controller 212 may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode. In other examples, a timer may be set which, upon the timer expiring, the controller may be returned to the awake mode.

Undesired evaporative emissions detection routines may be intermittently performed by controller 212 on fuel system 218 and evaporative emissions control system 251 to confirm that the fuel system and/or evaporative emissions control system is not degraded (e.g., presence of a leak, formation of a clog or backpressure greater than a determined value, sensor/actuator not sensing or actuating as desired). As such, evaporative emissions detection routines may be performed while the engine is off (engine-off evaporative emissions test) using engine-off natural vacuum (EONV) generated due to a change in temperature and pressure at the fuel tank following engine shutdown and/or with vacuum supplemented from a vacuum pump. Alternatively, undesired evaporative emissions detection routines may be performed while the engine is running by operating a vacuum pump (not shown) and/or using engine intake manifold vacuum.

In some configurations, a canister vent valve (CVV) 297 may be coupled within vent line 227. CVV 297 may function to adjust a flow of air and vapors between the one or more fuel vapor canisters and the atmosphere. The CVV may also be used for diagnostic routines. When included, the CVV may be opened during fuel vapor storing operations (for example, during fuel tank refueling and while the engine is not running) so that air, stripped of fuel vapor after having passed through the one or more fuel vapor canisters, can be pushed out to the atmosphere. Likewise, during purging operations (for example, during canister regeneration and while the engine is running), the CVV may be opened to allow a flow of fresh air to strip the fuel vapors stored in the one or more fuel vapor canisters. In some examples, CVV 297 may be a solenoid valve wherein opening or closing of the valve is performed via actuation of a canister vent solenoid. In particular, the canister vent valve may be an open that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed is reduced. In one example, the CVV may be closed while the vehicle is off, thus maintaining battery power while maintaining the fuel emissions control system sealed from atmosphere, however in other examples the CVV may be opened during vehicle-off conditions.

As discussed above, while FIG. 2 depicts an evaporative emissions system with two canisters, an evaporative emissions system may include any number of canisters. Accordingly, FIG. 3 depicts one example illustration of an evaporative emissions control system 305 depicting three fuel vapor canisters in series. The components of evaporative emissions control system 305 are the same as those depicted in FIG. 2, with the additional components herein described. For example, evaporative emissions control system 305 further comprises a third fuel vapor canister 229, including a third canister buffer 229*a*. Housed within third fuel vapor canister 229 is third canister temperature sensor 232*c*. Third fuel vapor canister further comprises a load/purge port 288*c*, and a vent port 289*c*. Additionally, a second bypass conduit 265*b* is shown, wherein one end (e.g., first end) of the second bypass conduit 265*b* is coupled to vent line 227 at a point between first fuel vapor canister 222 and second fuel vapor canister 226, and wherein the other end (e.g., second end) is coupled to vent line 227 at a point between second fuel vapor canister 226 and third fuel vapor canister 229. Second bypass valve 263*b* may be housed within second bypass conduit 265*b*, and may be configured to open and close based on commands from the controller. FIG. 3 thus depicts an example where the canister closest to atmosphere (e.g. third canister) does not have a bypass conduit associated, and thus cannot be bypassed.

FIG. 3 illustrates a diagnostic event where each of the first canister 222, the second canister 226, and the third canister 229 are bypassed via a plurality of canister bypasses. In other words, FIG. 3 represents a situation where each of the first bypass valve 263*a*, the second bypass valve 263*b*, and the third bypass valve 263*c* are commanded open. The bypass valves may be commanded open in response to a request to diagnose a condition of a pressure sensor, such as FTPT 291 of FIG. 2. The pressure sensed by the pressure sensor may be compared to a response of the hydrocarbon sensor 299, to which vapors are directly flowed via bypassing the canisters. In one example, the first canister bypass 265*a* bypasses fuel vapors from the fuel vapor conduit 278 to a first junction arranged between the first canister 222 and the second canister 226. The second canister bypass 265*b* bypasses fuel vapors from the first junction to a second junction arranged between the second canister 226 and the third canister 229. The third canister bypass 265*c* bypasses fuel vapors from the second junction to the hydrocarbon sensor 299 arranged in a third junction between the third canister 229 and the canister vent valve 297. Additionally or alternatively, the third junction may be between the third canister 229 and the ELCM.

The hydrocarbon sensor 299 may seal the extreme end of the third bypass 265*c* distal to the second junction, in one example. Additionally or alternatively, the hydrocarbon sensor 299 may be positioned to receive vapors directly from the third bypass 265*c* such that there are no additional or intervening components between the third bypass valve 263*c* and the hydrocarbon sensor 299. In some embodiments, additionally or alternatively, the hydrocarbon sensor 299 may be configured to sense gases within the vent line 227 at the third junction.

Thus, discussed herein a system for a vehicle may comprise an evaporative emissions system fluidically coupled to a fuel system that includes a fuel tank, the evaporative emissions system including two or more fuel vapor storage canisters. Such a system may further include a fuel tank pressure transducer (FTPT) and a fuel level indicator coupled to the fuel tank. Such a system may further include a controller with computer readable instructions stored on non-transitory memory that are executed during a vehicle and/or engine on event to determine a condition of the FTPT based on feedback of a hydrocarbon sensor arranged in the evaporative emissions system. The instructions may cause the controller to compare an output of the hydrocarbon sensor to a threshold value, the threshold value may be based on a pressure sensed by the FTPT or a predetermined value. If the output of the hydrocarbon sensor does not match the pressure sensed by the FTPT, then the FTPT may be degraded. In one example, the output of the hydrocarbon sensor may include an amount of hydrocarbons present in the vapor flow, wherein as the amount increases, a pressure within the fuel tank increases during the diagnostic conditions. Thus, if an expected amount of hydrocarbon based on the pressure sensed by the FTPT does not match the amount of hydrocarbons sensed by the hydrocarbon sensor, then the FTPT may be degraded. If the values match, then the FTPT may not be degraded. The FTPT may be degraded due to a disconnected electrical source and/or a stuck/leaking diaphragm within the FTPT. Diagnosing the FTPT via the hydrocarbon sensor may eliminate additional hardware being added to the fuel system while reducing unnecessary replacement of the FTPT when it is not degraded.

Turning now to FIG. 4, it shows a method 400 for diagnosing an FTPT of a fuel system. Instructions for carrying out method 400 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 402, the method 400 includes determining current operating parameters. Current operating parameters may include, but are not limited to, one or more of an engine speed, an engine temperature, a throttle position, a vehicle speed, and an air/fuel ratio.

At 404, the method 400 may include determining if entry conditions are met for diagnosing a condition of a FTPT (e.g., FTPT 291 of FIG. 2). Entry conditions may include an engine being on, a fuel temperature being greater than a threshold temperature and/or the evaporative emissions system being free of a leak or other degradation. The threshold temperature may be based on a non-zero, positive value. Additionally or alternatively, a drive cycle duration may be an entry condition. The drive cycle duration may be adjusted in response to one or more of a fuel level in a fuel tank and an ambient temperature. For example, the drive cycle duration may decrease in response to the fuel level decreasing and/or the ambient temperature increasing. As another example, the drive cycle duration may increase in response to the fuel level increasing and/or the ambient temperature decreasing. The drive cycle duration may be based on the threshold temperature, wherein once the drive cycle duration has elapsed, the fuel temperature may be equal to or greater than the threshold temperature. Additionally or alternatively, the drive cycle duration may be based on a purging of the canister to the engine. That is to say, a load of the canister may be reduced to less than a threshold load following the drive cycle duration. Methods for diagnosing a leak in an evaporative emissions system is described in U.S. Pat. No. 9,429,114, which is incorporated by reference herein.

If the entry conditions are not met, then at 406, the method 400 may include not executing the FTPT diagnostic. As such, the canister bypass valve may not be opened and vapors may not be directly flowed to the hydrocarbon sensor. If the entry conditions are met, then the method 400 may include execute the FTPT diagnostic.

At 408, the method 400 may include closing the FTIV and CPV. As such, the vapors in the evaporative emissions system may increase. In one example, the CVV may be closed during an entirety of the diagnostic, thereby blocking communication between the evaporative emissions system and atmosphere.

At 410, the method 400 may include determining if a threshold duration has elapsed. The threshold duration may be based on a desired pressure generated within the evaporative emissions system. The threshold duration, additionally or alternatively, may be based on a fixed duration (e.g., 1 minute, 3 minutes, 5 minutes, etc.).

If the threshold duration has not elapsed, then at 412, the method 400 may include continuing allowing vapors to build in the evaporative emissions systems. The FTIV and the CPV are maintained in the fully closed positions.

If the threshold duration has elapsed, then at 414, the method 400 may include opening the first, second, and third bypass valves.

At 416, the method 400 may include opening the FITV. As such, fuel vapors may flow from the fuel system to the evaporative emissions system.

At 418, the method 400 may include flowing vapors to the HC sensor. The hydrocarbons may flow through the first bypass, the second bypass, and the third bypass, wherein the third bypass flows the vapors directly to the hydrocarbon sensor. In one example, the vapors from the fuel tank are captured in the canister and do not flow to the hydrocarbon sensor.

At 420, the method 400 may include determining if a sensed hydrocarbon amount is greater than a threshold value, such as a determined hydrocarbon amount. The determined hydrocarbon amount may be based on an anticipated hydrocarbon presence based on a positive pressure of vapor present in the fuel tank vapor. In one example, the threshold hydrocarbon amount may be equal to 5%, 10%, 15%, 20%, or another percentage. In one example, the determined hydrocarbon amount is set to increase a confidence value of the diagnostic determination.

If the sensed hydrocarbon amount is not greater than the threshold amount, then at 422, the method 400 may include determining the FTPT is not degraded and the diagnostic is passed. An indicator lamp is not activated to indicate degradation of the FTPT. Diagnostic routines utilizing the FTPT may continue to be executed when desired/requested.

If the sensed hydrocarbon amount is greater than the threshold amount, then at 424, the method 400 may include determining the FTPT is degraded and the diagnostic is not passed. In one example, the indicator lamp may be activated. Additionally or alternatively, an alert may be sent to a vehicle operator via a text, an email, or a phone call. In some examples, an alert may be sent to a manufacturer, a vehicle service center, or both. The vehicle service center may correspond to a location in which the vehicle operator receives maintenance and service. In some examples, an appointment for service may be scheduled with the service center based on a vehicle operator availability, the vehicle operator availability based on a calendar and/or schedule input into an infotainment system of the vehicle or communicated to the vehicle via a wireless device.

After 422 or 424, the method 400 proceeds to 426, which may include closing the FTIV. As such, the fuel tank is sealed from the evaporative emissions system.

At 428, the method 400 may include executing a purge of the evaporative emissions system. Thus, the CPV may be opened, the CVV maintained closed, and fuel vapors from the bypass passages and the evaporative emissions may flow to the engine during the purge. If the diagnostic is not passed, then evaporative emissions system diagnostics are deactivated until the FTPT is repaired.

Turning now to FIG. 5, it shows a timeline 500 illustrating an operating sequence based on the method 400 of FIG. 4 and the systems of FIGS. 2 and 3. The operating sequence illustrates changes to fuel system conditions during a diagnosis of a FTPT. Plot 505 illustrates a fuel temperature. Plot 510 illustrates a FTIV position. Plot 515 illustrates a CPV position. Plot 520 illustrates a first bypass valve position. Plot 525 illustrates a second bypass valve position. Plot 530 illustrates a third bypass valve position. Plot 535 illustrates an evaporative system pressure. Plot 540 illustrates a hydrocarbon sensor output and dashed line 542 illustrates a threshold value. Plot 545 illustrates a diagnostic result. Plot 550 illustrates a FTPT sensor output. Time increases from a left to a right side of the figure.

Prior to t1, the fuel temperature (plot 505) increases from a relatively low temperature as a drive cycle progresses. The time desired for the fuel temperature to increase may be adjusted based on ambient temperature and a fuel level. For example, the time desired may decrease as the ambient temperature increases and as the fuel level decreases. The FTIV and CPV are open (plots 510 and 515, respectively), allowing the evaporative emissions system, and canisters arranged therein, to purge and clean (e.g., return to a less loaded state). The first, second, and third bypass valves are in a fully closed position (plots 520, 525, and 530, respectively). The FTPT sensor (plot 550) outputs a constant zero pressure value.

At t1, the desired time has elapsed and entry conditions for the diagnostic test of the FTPT are complete. The FTIV and the CPV are moved to closed positions and pressure in the evaporative emissions system increases between t1 and t2.

At t2, the evaporative emissions system pressure reaches a desired value. Vapors may begin to be directed to the hydrocarbon sensor via opening the first bypass valve, the second bypass valve, and the third bypass valve. Additionally, the FTIV may be moved to an open position. However, vapors from the fuel tank may be captured by the bleed canister and may not reach the hydrocarbon sensor.

Between t2 and t3, the hydrocarbon sensor senses a hydrocarbon value above the threshold value. In one example, the threshold value is based on an amount of hydrocarbon sensed at the hydrocarbon sensor when a positive pressure is present in the fuel tank. As such, if the hydrocarbon sensor senses a hydrocarbon value above the threshold value and the FTPT sensor continues to sense a zero pressure value, then the diagnostic is not passed.

At t3, the diagnostic result is marked as failed. The diagnostic is exited via opening the CPV and closing the FTIV. The bypass valves are maintained open and the evaporative emissions system is purged at and after t3. The indication of the failed diagnostic is maintained until the FTPT is repaired or replaced. By doing this, the FTPT may be diagnosed as degraded or not degraded, which may decrease vehicles costs by avoiding unnecessary replacement of the FTPT In this way, a pressure sensor of a fuel system may be diagnosed via a hydrocarbon sensor. The technical effect of determining a condition of the pressure sensor via the hydrocarbon sensor is to utilize hardware present in the evaporative emissions system and increase a fidelity of diagnostic results executed in combination with the pressure sensor. Furthermore, waste associated with replacement of correctly operating pressure sensors may be avoided, which may decrease vehicle maintenance costs.

The disclosure provides support for a method including flowing gases directly to a hydrocarbon sensor via a canister bypass and diagnosing a condition of a fuel tank pressure transducer (FTPT) based on a response of the hydrocarbon sensor. A first example of the method further includes where the canister bypass is one of a plurality of canister bypasses, further comprising generating an alert and sending the alert to a vehicle operator in response to the condition of the FTPT being degraded. A second example of the method, optionally including the first example, further includes where opening a fuel tank isolation valve (FTIV) and a bypass valve arranged in the canister bypass prior to flowing gases directly to the hydrocarbon sensor. A third example of the method, optionally including one or more of the previous examples, further including determining the condition of the FTPT to be degraded when the response of the hydrocarbon sensor indicates a hydrocarbon sensed greater than a threshold value. A fourth example of the method, optionally including one or more of the previous examples, further including blocking diagnostics for an evaporative emissions system using the FTPT in response to the condition of the FTPT being degraded. A fifth example of the method, optionally including one or more of the previous examples, further including determining the condition of the FTPT to be not degraded when the response of the hydrocarbon sensor indicates a hydrocarbon amount sensed is less than or equal to the threshold value.

The disclosure further provides support for a system including a fuel tank, a first canister coupled to the fuel tank via a fuel vapor conduit, a second canister arranged between the first canister and a third canister, the third canister arranged between the second canister and a hydrocarbon sensor, a first canister bypass coupled to the fuel vapor conduit and a first junction between the first canister and the second canister, a second canister bypass coupled to the first junction and a second junction between the second canister and the third canister, a third canister bypass coupled to the second junction and the hydrocarbon sensor, a first bypass valve arranged in the first canister bypass, a second bypass valve arranged in the second canister bypass, and a third bypass valve arranged in the third canister bypass, and a controller comprising instructions stored on non-transitory memory thereof that when executed cause the controller to execute a diagnostic to determine a condition of a fuel tank pressure transducer (FTPT) in response to feedback from the hydrocarbon sensor. A first example of the system further includes where the FTPT is arranged between the fuel tank and the fuel vapor conduit. A second example of the system, optionally including the first example, further includes where the instructions further enable the controller to close a fuel tank isolation valve (FTIV) arranged in the fuel vapor conduit and close a purge valve arranged in a purge line coupled to an intake manifold and the first canister during a beginning of the diagnostic. A third example of the system, optionally including one or more of the previous examples, further includes where the instructions further enable the controller to open the FTIV, the first bypass valve, the second bypass valve, and the third bypass valve. A fourth example of the system, optionally including one or more of the previous examples, further includes where the instructions further enable the controller to determine a degradation of the FTPT in response to feedback from the hydrocarbon sensor indicating an amount of hydrocarbons greater than a threshold value. A fifth example of the system, optionally including one or more of the previous examples, further includes where the threshold value is based on a positive pressure being present in the fuel tank. A sixth example of the system, optionally including one or more of the previous examples, further includes where the instructions further enable the controller determine no degradation of the FTPT in response to feedback from the hydrocarbon sensor indicating the amount of hydrocarbons being less than or equal to the threshold value. A seventh example of the system, optionally including one or more of the previous examples, further includes where the hydrocarbon sensor seals the third canister bypass. An eighth example of the system, optionally including one or more of the previous examples, further includes where the hydrocarbon sensor is arranged between the third canister and atmosphere, and wherein the third canister bypass flows gases to only the hydrocarbon sensor.

The disclosure further provides support for a fuel system for a vehicle including a fuel tank and a fuel tank pressure transducer (FTPT) configured to sense a pressure of the fuel tank via a fuel vapor conduit, an evaporative emissions system comprising a plurality of canisters comprising a first canister, a second canister, and a third canister, wherein the first canister is fluidly coupled to the fuel vapor conduit, a plurality of canister bypasses comprising a first bypass configured to flow vapors from the fuel vapor conduit to a first junction between the first canister and the second canister, a second bypass configured to flow vapors from the first junction to a second junction between the second canister to the third canister, and a third bypass configured to flow vapors from the second junction to a hydrocarbon sensor, a plurality of bypass valves comprising a first bypass valve arranged in the first bypass, a second bypass valve arranged in the second bypass, and a third bypass valve arranged in the third bypass, and a controller comprising instructions stored on memory thereof that when executed enable the controller to determine entry conditions for being met for a diagnostic of the FTPT, and diagnose a condition of the FTPT based on feedback from the hydrocarbon sensor. A first example of the fuel system further includes where the instructions further enable the controller to open the plurality of bypass valves and flow vapors directly to the hydrocarbon sensor. A second example of the fuel system, optionally including the first example, further includes where the instructions further enable the controller to open a fuel tank isolation valve (FTIV) in the fuel vapor conduit. A third example of the fuel system, optionally including one or more of the previous examples, further includes where the third bypass extends from the second junction into a vent line coupled to the third canister and atmosphere, wherein the third bypass flows vapors to only the hydrocarbon sensor. A fourth example of the fuel system, optionally including one or more of the previous examples, further includes where the instructions further enable the controller to purge the plurality of canisters following the diagnostic.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

flowing gases directly to a hydrocarbon sensor via a canister bypass; and diagnosing a condition of a fuel tank pressure transducer (FTPT) based on a response of the hydrocarbon sensor.

2. The method of claim 1, wherein the canister bypass is one of a plurality of canister bypasses, further comprising generating an alert and sending the alert to a vehicle operator in response to the condition of the FTPT being degraded.

3. The method of claim 1, further comprising opening a fuel tank isolation valve (FTIV) and a bypass valve arranged in the canister bypass prior to flowing gases directly to the hydrocarbon sensor.

4. The method of claim 1, further comprising determining the condition of the FTPT to be degraded when the response of the hydrocarbon sensor indicates a hydrocarbon sensed greater than a threshold value.

5. The method of claim 4, further comprising blocking diagnostics for an evaporative emissions system using the FTPT in response to the condition of the FTPT being degraded.

6. The method of claim 4, wherein determining the condition of the FTPT to be not degraded when the response of the hydrocarbon sensor indicates a hydrocarbon amount sensed is less than or equal to the threshold value.

7. A system, comprising:

a fuel tank;

a first canister coupled to the fuel tank via a fuel vapor conduit;

a second canister arranged between the first canister and a third canister, the third canister arranged between the second canister and a hydrocarbon sensor;

a first canister bypass coupled to the fuel vapor conduit and a first junction between the first canister and the second canister;

a second canister bypass coupled to the first junction and a second junction between the second canister and the third canister;

a third canister bypass coupled to the second junction and the hydrocarbon sensor;

a first bypass valve arranged in the first canister bypass, a second bypass valve arranged in the second canister bypass, and a third bypass valve arranged in the third canister bypass; and a controller comprising instructions stored on non-transitory memory thereof that when executed cause the controller to:

execute a diagnostic to determine a condition of a fuel tank pressure transducer (FTPT) in response to feedback from the hydrocarbon sensor.

8. The system of claim 7, wherein the FTPT is arranged between the fuel tank and the fuel vapor conduit.

9. The system of claim 7, wherein the instructions further enable the controller to close a fuel tank isolation valve (FTIV) arranged in the fuel vapor conduit and close a purge valve arranged in a purge line coupled to an intake manifold and the first canister during a beginning of the diagnostic.

10. The system of claim 9, wherein the instructions further enable the controller to open the FTIV, the first bypass valve, the second bypass valve, and the third bypass valve.

11. The system of claim 7, wherein the instructions further enable the controller to determine a degradation of the FTPT in response to feedback from the hydrocarbon sensor indicating an amount of hydrocarbons greater than a threshold value.

12. The system of claim 11, wherein the threshold value is based on a positive pressure being present in the fuel tank.

13. The system of claim 11, wherein the instructions further enable the controller to determine no degradation of the FTPT in response to feedback from the hydrocarbon sensor indicating the amount of hydrocarbons being less than or equal to the threshold value.

14. The system of claim 7, wherein the hydrocarbon sensor seals the third canister bypass.

15. The system of claim 7, wherein the hydrocarbon sensor is arranged between the third canister and atmosphere, and wherein the third canister bypass flows gases to only the hydrocarbon sensor.

16. A fuel system for a vehicle, comprising a fuel tank and a fuel tank pressure transducer (FTPT) configured to sense a pressure of the fuel tank via a fuel vapor conduit;

an evaporative emissions system comprising a plurality of canisters comprising a first canister, a second canister, and a third canister, wherein the first canister is fluidly coupled to the fuel vapor conduit;

a plurality of canister bypasses comprising a first bypass configured to flow vapors from the fuel vapor conduit to a first junction between the first canister and the second canister, a second bypass configured to flow vapors from the first junction to a second junction between the second canister to the third canister, and a third bypass configured to flow vapors from the second junction to a hydrocarbon sensor;

a plurality of bypass valves comprising a first bypass valve arranged in the first bypass, a second bypass valve arranged in the second bypass, and a third bypass valve arranged in the third bypass; and a controller comprising instructions stored on memory thereof that when executed enable the controller to:

determine entry conditions for being met for a diagnostic of the FTPT; and diagnose a condition of the FTPT based on feedback from the hydrocarbon sensor.

17. The fuel system of claim 16, wherein the instructions further enable the controller to open the plurality of bypass valves and flow vapors directly to the hydrocarbon sensor.

18. The fuel system of claim 17, wherein the instructions further enable the controller to open a fuel tank isolation valve (FTIV) in the fuel vapor conduit.

19. The fuel system of claim 16, wherein the third bypass extends from the second junction into a vent line coupled to the third canister and atmosphere, wherein the third bypass flows vapors to only the hydrocarbon sensor.

20. The fuel system of claim 16, wherein the instructions further enable the controller to purge the plurality of canisters following the diagnostic.

* * * * *